US006227660B1

(12) United States Patent
McClelland et al.

(10) Patent No.: US 6,227,660 B1
(45) **Date of Patent: *May 8, 2001**

(54) PRINTHEAD WITH PUMP DRIVEN INK CIRCULATION

(75) Inventors: Paul H. McClelland, Monmouth, OR (US); Kenneth E. Trueba, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/389,878

(22) Filed: Sep. 2, 1999

Related U.S. Application Data

(63) Continuation of application No. 08/550,698, filed on Oct. 31, 1995, now Pat. No. 6,017,117.

(51) Int. Cl.[7] ..... B41J 2/175

(52) U.S. Cl. ..... 347/85; 347/84; 347/89; 417/413.2; 417/322

(58) Field of Search ..... 347/84, 85, 44, 347/45, 48, 89, 92; 417/413.2, 413.3, 322

(56) References Cited

U.S. PATENT DOCUMENTS

| | | | | |
|---|---|---|---|---|
| 3,606,592 | | 9/1971 | Madurski et al. | 417/413 |
| 4,183,031 | * | 1/1980 | Kyser et al. | 347/86 |
| 4,312,010 | * | 1/1982 | Doring | 346/140 R |
| 4,648,807 | | 3/1987 | Tippetts et al. | 417/322 |
| 4,725,002 | * | 2/1988 | Trachte | 239/102.2 |
| 4,929,963 | | 5/1990 | Balazar | 346/1.1 |
| 4,975,143 | | 12/1990 | Drake et al. | 156/633 |
| 5,019,139 | * | 5/1991 | LaPack et al. | 55/158 |
| 5,023,625 | | 6/1991 | Bares et al. | 346/1.1 |
| 5,229,793 | * | 7/1993 | Hadimioglu et al. | 346/140 R |
| 6,017,117 | * | 1/2000 | McClelland et al. | 347/84 |

FOREIGN PATENT DOCUMENTS

| | | | | |
|---|---|---|---|---|
| 0498293 A2 | | 1/1992 | (EP) | B41J/2/155 |
| 0566119 A2 | | 4/1993 | (EP) | B41J/2/505 |
| 56-24173 | * | 3/1981 | (JP) | 347/48 |
| WO94/01285 | | 1/1994 | (WO) | B41J/2/155 |

OTHER PUBLICATIONS

"The Applications Of Ferroelectric Polymers", Blackie and Son, Ltd. Bishopbriggs, Glasgow G642NZ 7–Leicester Place, London WC2H 7BP, 1988, pp 305–328.

* cited by examiner

*Primary Examiner*—John Barlow
*Assistant Examiner*—M Shah
(74) *Attorney, Agent, or Firm*—Raymond A. Jenski

(57) ABSTRACT

A printhead for an inkjet printer employs an integral pump disposed in an ink feed channel, input well, or output well to circulate ink to the ink expulsion chambers in the printhead.

11 Claims, 9 Drawing Sheets

SECTION *D-D*

SECTION C-C

SECTION D-D

SECTION D-D

PRINTHEAD WITH PUMP DRIVEN INK CIRCULATION

CROSS REFERENCE TO RELATED APPLICATION(S)

This is a continuation of application Ser. No. 08/550,698 filed on Oct. 31, 1995, U.S. Pat. No. 6,017,117.

The present invention is generally related to a pump circulation of ink for an inkjet printer printhead and is more particularly related to an ink pump particularly useful for a large area printhead and which circulates ink, purges air, and/or regulates the backpressure in the ink expulsion chambers of the printhead. The present application is related to U.S. patent application Ser. No. 08/551,266 titled "Large Area InkJet Printhead", filed on behalf of Paul H. McClelland et al. on the same day as the present application and assigned to the assignee of the present invention.

BACKGROUND OF THE INVENTION

Inkjet printing has become widely known and is most often implemented using thermal inkjet technology. Such technology forms characters and images on a medium, such as paper, by expelling droplets of ink in a controlled fashion so that the droplets land on the medium. The printer, itself, can be conceptualized as a mechanism for moving and placing the medium in a position such that the ink droplets can be placed on the medium, a printing cartridge which controls the flow of ink and expels droplets of ink to the medium, and appropriate hardware and software to position the medium and expel droplets so that a desired graphic is formed on the medium. A conventional print cartridge for an inkjet type printer comprises an ink containment device and an ink-expelling apparatus, commonly known as a printhead, which heats and expels ink droplets in a controlled fashion. Typically, the printhead is a laminate structure including a semiconductor or insulator base, a barrier material structure which is honeycombed with ink flow channels, and an orifice plate which is perforated with nozzles or orifices with diameters smaller than a human hair and arranged in a pattern which allows ink droplets to be expelled. In an inkjet printer the heating and expulsion mechanism consists of a plurality of heater resistors formed on the semiconductor or insulating substrate and associated with an ink firing chamber formed in the barrier layer and one of the orifices in the orifice plate. Each of the heater resistors is connected to the controlling mechanism of the printer such that each of the resistors may be independently energized to quickly vaporize to expel a droplet of ink.

Most currently available thermal inkjet printers utilize a print cartridge which has a relatively small printhead (approximately 5 mm×10 mm) adjacent the media to be printed upon. The cartridge also contains a volume of ink which is coupled to the printhead. The entire print cartridge, including the volume of ink, is caused to shuttle back and forth across the width of a page of medium, laying down a swath of printed ink as the cartridge is moved across the page. Once the cartridge reaches the end of its print line, the medium is advanced perpendicularly to the direction of shuttle and another swath of ink is printed across the page. Moving the mass of ink contained in the print cartridge across the page places a limit on the speed at which the page can be printed and also constrains the amount of ink which can be stored in a print cartridge.

One technique which reduces or eliminates the shuttling of the print cartridge back and forth across the whole page is to utilize a printhead which is at least as wide as the media upon which print is to be placed, i.e. a page-wide printhead. Such an apparatus would print one or more lines at one time as the media is advanced, line by line, in a direction perpendicular to the long axis of the page-wide printhead. One such page-wide printhead has been described in U.S. patent application Ser. No. 08/192,087 "Unit Printhead Assembly For Ink-Jet Printing" filed on behalf of Cowger et al. on Feb. 4, 1994. This page-wide printhead employs a plurality of substrate modules aligned across the long axis of the page-wide printhead to enable easy replacement should one of the modular printheads suffer a failure.

One inherent problem with conventional page-wide printheads is that of manufacturability and thermal stability across the width of a page. In printers designed for office or home use, the width of a page-wide printhead equals 22 cm or more. In order to print with acceptable print quality, a page-wide printhead may have approximately 4800 printing orifices extending along the long dimension of the page-wide printhead. Because these orifices are small and misregistration of one orifice to another creates objectionable degradations in the quality of printing, it is important that the orifices be assembled with exceptional dimensional care and that the dimensions are held relatively constant over variations in temperature. Adding further to the temperature instability is the use of several different materials in the assembly of a conventional page-wide printhead. The printhead body typically is manufactured from plastic or metallic materials, upon which silicon substrates containing the firing resistors are affixed. The substrates are interconnected with a polyimide or other flexible polymer material. Each of these materials has a different coefficient of thermal expansion which leads to unacceptable misregistration of nozzles with temperature changes. An improperly matched set of materials can lead to rapid failure of a page-wide printhead. U.S. patent application Ser. No. 08/375,754 "Kinematically Fixing Flex Circuit to PWA Printbar" filed on behalf of Hackleman on Jan. 20, 1995, addresses one technique of accounting for thermal expansion of various materials used in a page-wide printhead. Furthermore, U.S. patent application Ser. No. 08/516,270 "Pen Body Exhibiting Opposing Strain To Counter Thermal Inward Strain Adjacent Flex Circuit" filed on behalf of Cowger on Aug. 17, 1995, provides an example of a plastic printhead body which may be designed to compensate the difference in thermal expansion of the various materials used in its construction.

Ink which circulates within the printing mechanism is subject to air bubbles forming within the ink passageways and interfering with adequate ink supply. In order that sufficient ink be supplied to each ink firing chamber and to purge air bubbles from the system, ink pumping devices have been utilized previously to provide ink. These solutions have utilized ink pumps which, because of their size and mass, have been disposed elsewhere within the printer and coupled to the printhead with tubes. This arrangement has the disadvantage of having a separate component pump with its attendant fluid connections to reduce reliability and increase cost.

SUMMARY OF THE INVENTION

A printhead for an inkjet printer employs a stable base having an integral inkfeed channel. A plurality of ink expulsion chambers are disposed on the stable base and are supplied with ink via the integral ink feed channel in the stable base. A pump disposed on the stable base couples ink to the integral ink feed channel and circulates ink for expulsion by the ink expulsion chambers.

DETAILED DESCRIPTION OF A PREFERRED EMBODIMENT

Figure 1:
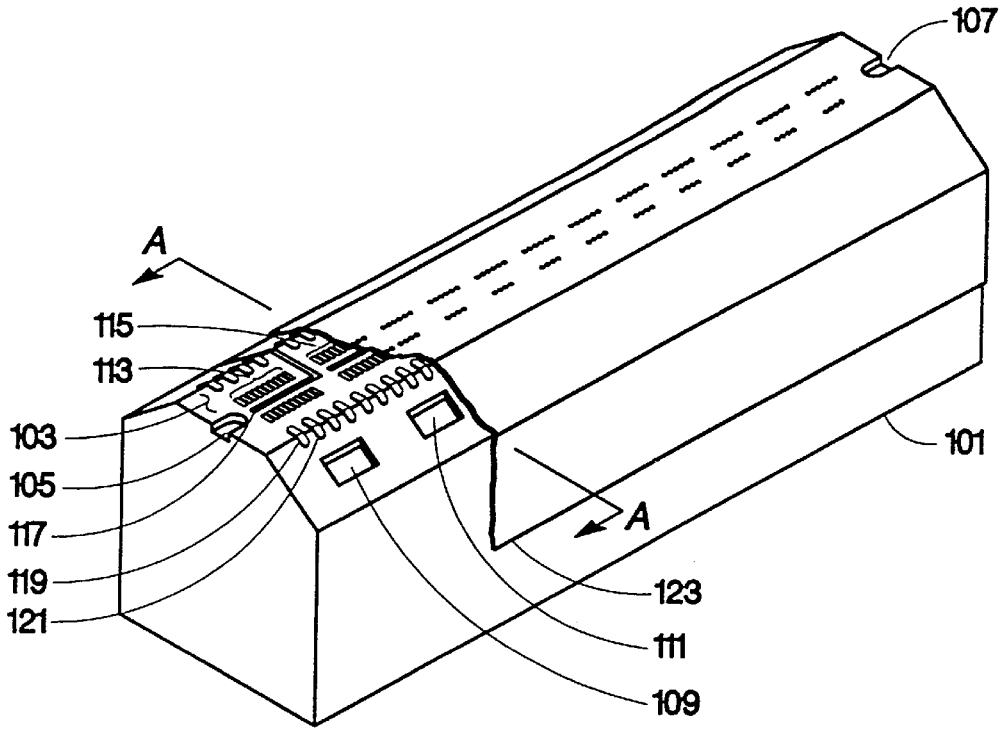
FIG. 1 is an isometric view of a large area printhead which illustrates the orientation of heater resistors and driver circuitry in cutaway and which may employ the present invention.
Figure 2:
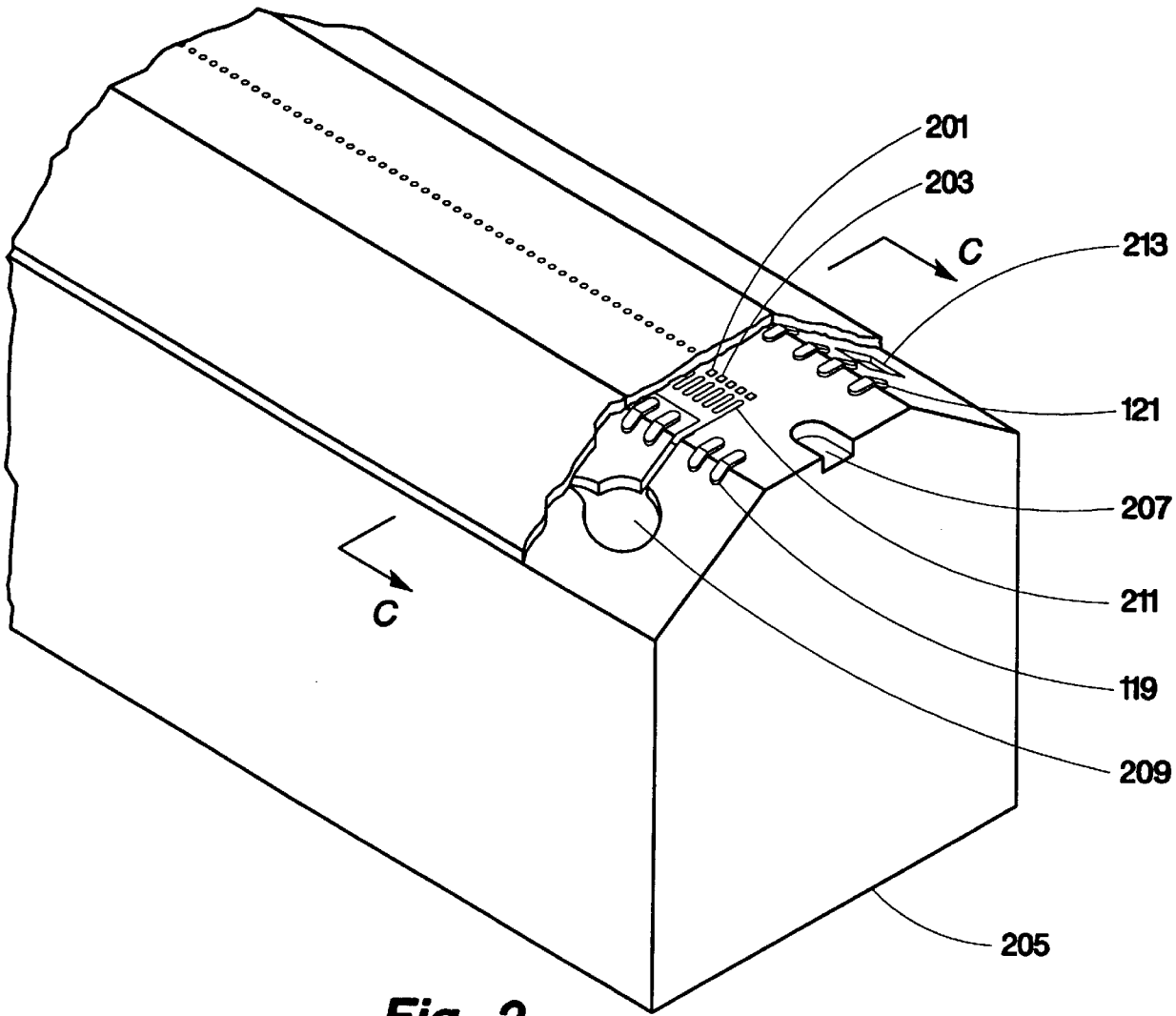
FIG. 2 is an isometric view of an alternative embodiment of the large area printhead of FIG. 1.

A page-wide large area printhead which may employ the present invention is shown in the isometric view of FIG. 1. A base of thermally stable material, such as fused high silica glass in the preferred embodiment, is cast into a elongate block 101 having approximate dimensions of 24 cm long by 2.5 cm high by 0.5 cm wide. One surface 103 of the thermally stable base block 101 is used as the printing surface and it is upon this surface that the heater resistors and other elements of the printing mechanism are constructed. The fused high silica glass is molded into its desired shape and two reference notches 105 and 107 are molded into opposite ends of the printhead base as shown. Also molded into the printhead base is an ink plenum and manifold which will be described later, and indentations 109 and 111 which are employed to house integrated circuits for energizing and controlling heater resistors. Groups of heater resistors 113 and 115 are deposited upon the block 101 by conventional sputtering techniques (but conventional evaporation or chemical vapor deposition may also be used) and are arranged, in the preferred embodiment, in two collinear rows extending from one end of the page-wide printhead to the other end. These collinear resistors are aligned parallel to a reference line created between reference notches 105 and 107. This technique results in the heater resistors being deposited with a registration of from 2 microns to 5 microns from one end of the printhead to the other. In order to realize high quality printing, in the preferred embodiment, there are approximately 4800 heater resistors in total. Each of the groups of heater resistors 113 and 115 are arranged around an integral ink feed channel 117 which is disposed between the two collinear rows of resistors for each resistor group and which provides ink to the firing chamber of each heater resistor as needed. Although the thermally stable base block 101 is constructed of fused silica glass in the present invention, other thermally stable insulators such as ceramic could also be used for the printhead base in the present invention. Alternatively, the heater resistors are constructed first in a plurality of silicon substrates which are then affixed to the thermally stable material of the block 101. In an alternative embodiment of the present invention, the thin film heater resistors (for example, heater resistors 201 and 203) are arranged in a single row as illustrated in FIG. 2. The block of high silica glass 205 has a reference notch 207 molded at each end of the block 205 as shown in FIG. 1 and has an ink inlet well, plenum and manifold 209 molded into one of the side surfaces 20 of the block 205. Each heater resistor is supplied ink by way of individual ink feed channels, for example ink feed channel 211 (corresponding to ink feed channel 117 of FIG. 1) from the ink inlet well, plenum and manifold 209. An indentation 213 is molded into the block 205 to accept an electronic integrated circuit for control and energizing the heater resistors.

Figure 3:
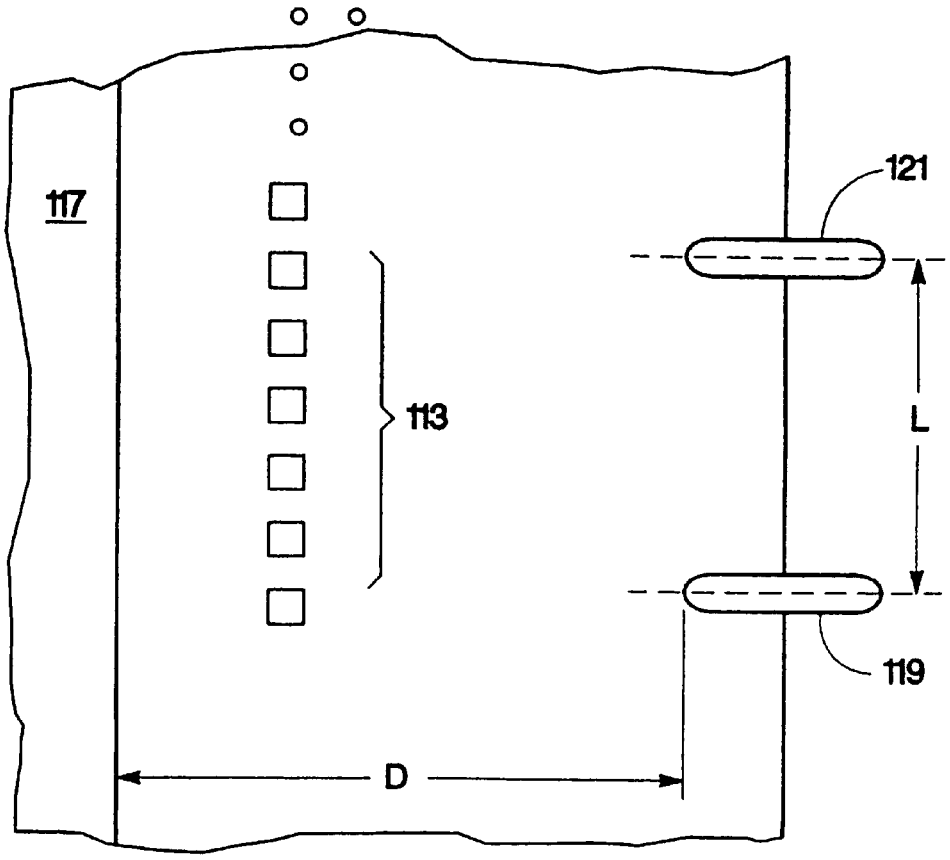
FIG. 3 is planar view of the print surface of the printhead of FIG. 1 which illustrates heater resistors and alignment features which may be employed in the present invention.

With the deposition of the heater resistors, a plurality of alignment features 119 and 121, for example, are created along the edge of the printhead surface by being molded into the block 101 or 205. In the preferred embodiment, the block 101 or 205, notches 105, 107, and 207, and reference features 119 and 121 are molded at the same time. As an alternative manufacturing technique, the block 101 or 205 and the notches 105, 107, and 207 may be contemporaneously molded and the reference features may be subsequently formed by surface grinding, etching, or similar process. Such a subsequent process must use an indexing technique to provide close tolerances between the reference features and notches 105, 107, and 207. Furthermore, the heater resistors are indexed to the reference features with a precision of approximately 2 microns. In the preferred embodiment, the reference features are raised, elongated protrusions extending 20 microns above the surface 103 of the block 101 and further extend approximately 2 mm beyond the plane of surface 103 and onto a side surface of block 101. The width of the reference feature is approximately 0.4 mm and the total length of each reference feature is approximately 4 mm. In the preferred embodiment the reference features, for example 119 and 121, are separated by a distance of L≅ mm and are displaced from the edge of the integral ink feed channel 117 by a distance of D≅ mm, as shown in FIG. 3.

Figure 4:
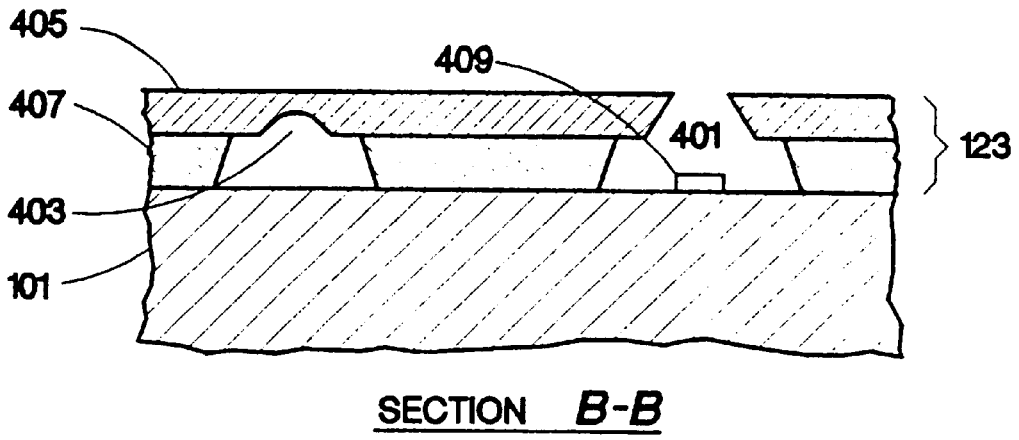
FIG. 4 is a cross sectioned view B—B of a portion of the flex circuit and printhead shown in FIG. 8.

Returning to FIG. 1, once the heater resistors and associated interconnect circuitry are deposited on the block 101, a layer of flex circuit 123 is stretched over the printing surface and down along the sides of the printhead block 101. Thus, a large number of orifices which penetrate the flex circuit are placed on the printing surface. The flex circuit forms the orifice layer of the printhead. In the preferred embodiment, the flex circuit is manufactured from a polyimide material such as KAPTON® E, available from E. I. DuPont de Nemours and Company, but other suitable electrically insulating flexible material such as polyester or polymethylmethacrylate may also be used. In the preferred embodiment, the flex circuit has conductive traces added to the polyimide material to provide electrical interconnection between the integrated circuits housed at 109 and 111 to the groups heater resistors at 113 and 115. In the preferred embodiment, the flex circuit 123 has conductive traces conventionally made of copper, but gold or other conductive material may also be used. The flex circuit also has holes fabricated through the polyimide material by conventional laser ablation processes in order to realize 18 microns diameter orifices at spacings of 85 microns (where the orifices are located in two parallel rows), or 42 microns (where the orifices are collinear). A process of removal of flex circuit material from the flex circuit forms reference indentations of approximately 25 microns which are coordinated with the orifices and which are fabricated to fit onto the reference features, for example 119 and 121, on the base 101. Also applied to the inner surface of the flex circuit is a suitable adhesive for the KAPTON® E material which is also photodefinable and capable of being etched. The photodefining and etching process, which is well known, is used to create ink passages and ink firing chambers 401 (in FIG. 4) and expansion features 403, to be described later. When the flex circuit 123 is applied to the block 101, it is heated and pressed upon the block 101. The outer surface of the flex circuit 405 is composed of the KAPTON® E material and the inner layer 407 is composed of the photodefinable adhesive. The ink firing chamber is formed around the firing resistor 409, its position indexed by the reference features and mating indentations in the flex circuit. As an alternative, the adhesive layer may be replaced by a layer KAPTON® F, thus forming a bilayer flex circuit.

Figure 5:
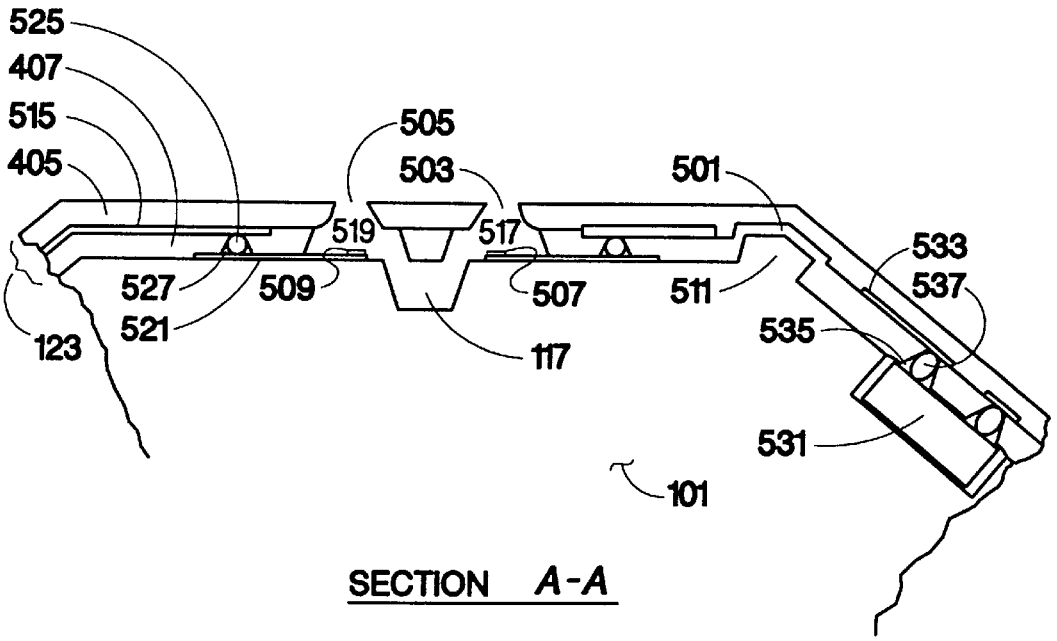
FIG. 5 is a cross sectioned view A—A of the printhead of FIG. 1.

Considering now FIG. 5, the application of the flex circuit to the base material 101 can be better understood. A cross section A—A perpendicular to the long axis of the printhead illustrates the flex circuit 123 affixed to the block 101 and illustrates the arrangement of components in the preferred embodiment. In manufacture of the printhead of the present invention, the flex circuit 123 is first applied to a center point of the print surface of block 101 and subsequently stretched simultaneously to both ends of the block 101. As the stretching occurs, alignment into the reference features, for example 119 and 121, occurs zipper-fashion from the central point of the block 101 to each end. This stretching method assures that the orifices in the flex circuit 123 are aligned over the heater resistors since the associated reference indentations in the flex circuit, for example 501, created in the flex circuit, force alignment between the orifices 503, 505, and the heater resistors 507, 509. The indentation 501 is inserted, zipper-like, on a corresponding reference feature 511 on the printhead base 101. In the preferred embodiment, the flex circuit is manufactured to be approximately 2% smaller than the printhead base 101 and is manufactured to have the previously mentioned expansion features disposed across the printing surface of the block 101 so that the flex material 123 is stretched to fit the print surface of the block 101. As shown in the cross section of FIG. 5, the flex material of the preferred embodiment consists of a polyimide outer layer 405, a conductive layer 515 which is selectively deposited upon the outer layer 405, and an inner layer 407 which is photolithographically defined and conventionally etched to produce vacancies in the barrier layer material in areas around the orifices (such as areas 517 and 519 forming the firing chambers for heater resistors 507 and 509 respectively). Vacancies are also photolithographically defined and etched in the inner layer 407 so that electrical connections may be made from conductor layer 515 to other conductive layers such as a metalization 521 deposited upon the block 101 leading to heater resistor 519. In the preferred embodiment, connection is made by a solder interconnect 525 by way of via 527 in the inner layer 407. A similar interconnect is made to heater resistor 507.

In the preferred embodiment, integrated circuits, such as integrated circuit 531, are used to provide signal multiplexing and drive power to the heater resistors. Interconnection is made by way of a patterned metalization layer 533 forming conductive traces to the heater resistor 507 and electrical interconnection is made between integrated circuit 531 and metalization layer 533 by way of a via 535 in the inner layer 407 and solder interconnection 537. The preferred technique of bonding the integrated circuit 531 to the flex circuit 123 is set forth by Hayashi in "An Innovative Bonding Technique For Optical Chips Using Solder Bumps That Eliminate Chip Positioning Adjustments" IEEE Transactions on Components, Hybrids, and Manufacturing Technology, Vol. 15, No. 2, April 1992, pp. 225–230.

An ink feed channel 117 provides an ink supply to the firing chambers of the heater resistors 517, 519, and the rest of the heater resistors in the associated group (such as groups 113 and 115). The ink feed channel 117 is formed as a groove in the printhead block 101 by molding the feature into the block at the same time the reference features are created.

Figure 6:
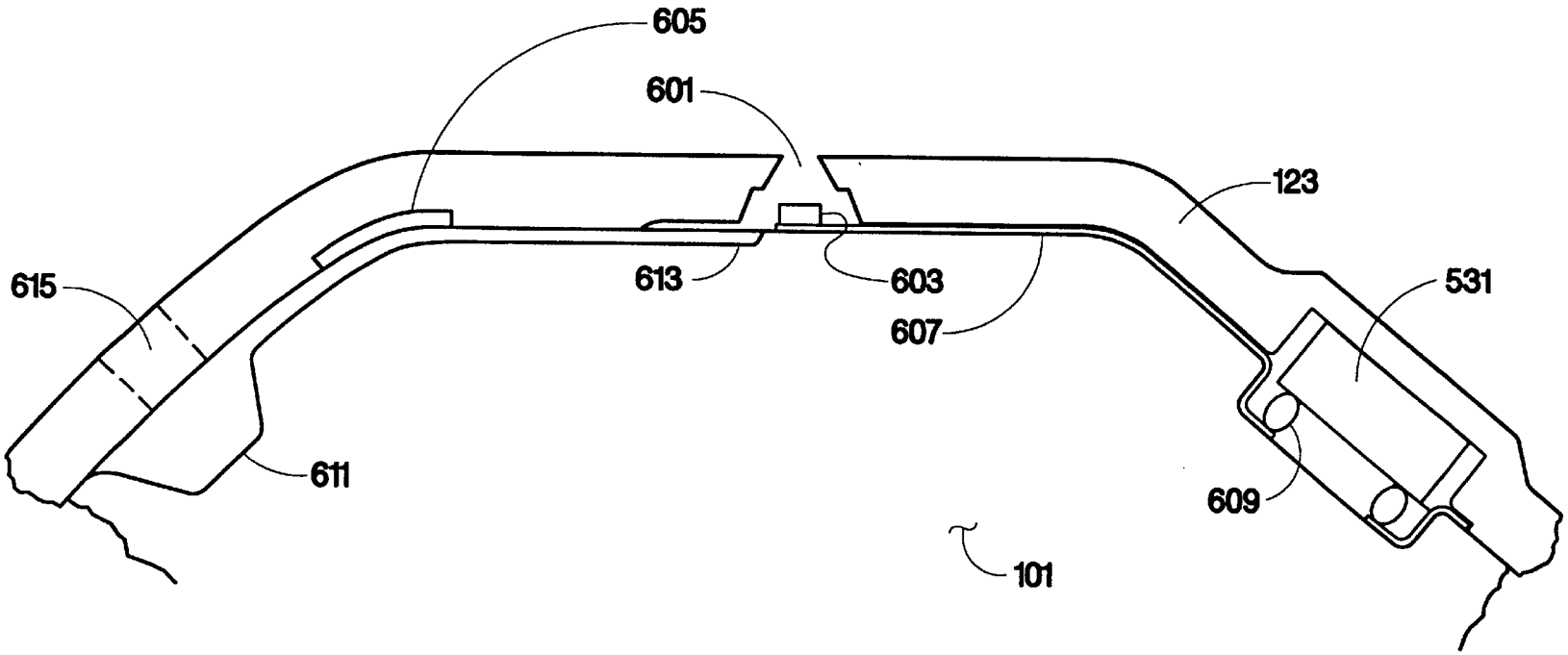
FIG. 6 is a cross section of the alternative embodiment of the large area printhead of FIG. 2.

An alternative embodiment is shown in the cross section of FIG. 6. As described above, a single row of orifices may be employed along the printing surface of the large area inkjet printhead. One orifice 601 and the associated heater resistor 603 is shown in the cross section. The orifice and its associated firing chamber is formed from the flex circuit 123, which may be a bilayer material or a single layer material having an adhesive layer. The flex circuit 123, as described previously, is first applied to the center portion of the printing surface of the block 101 and subsequently stretched simultaneously along the long axis of the block to the opposite ends. As the flex circuit is stretched, the flex circuit is fitted, zipper-like onto the reference features thereby providing mechanical referencing of the orifices in the flex circuit to the location of the heater resistors disposed on the block. Thus, the protruding reference feature 605 (having dimensions previously described) is fitted into a corresponding depression of flex circuit 123 to properly register orifice 601 to the heater resistor 603. The flex circuit 123 and block 101 are then heated to a temperature which activates the adhesive layer or causes the inner layer of the flex circuit to bond to the surface of the block 101.

In the alternative embodiment of FIG. 6, a patterned metalization layer 607 is conventionally deposited upon the surface of the block 101 to form conductive traces. These conductive traces provide electrical connection between the heater resistors, the multiplexer and driver circuitry, and the input to the printhead from the printer electronic circuitry. Thus, an integrated circuit such as integrated circuit 531 which would also be used in the preferred embodiment is coupled to heater resistor 603 by way of a solder interconnection 609. Unlike the preferred embodiment, the metalization is added to the surface of the block 101 rather than being part of the flex circuit 123.

Ink is delivered to the single row of orifices/heater resistors by way of a groove or ink feed channel 613 which is fed from an ink plenum and manifold 611. These features correspond to the ink feed channel 211 and ink plenum and manifold 209 of FIG. 2. In the alternative embodiment, each heater resistor is independently supplied via a separate ink feed channel. The ink plenum and manifold 611 and the ink feed channel 613 are created in the block 101 by molding at the same time as the reference features are created. The ink plenum and manifold and the ink feed channels may also be created after the block is molded by conventional etching or machining techniques. Ink is provided to the ink plenum by way of an ink inlet aperture 615 in the flex circuit 123.

Figure 7:
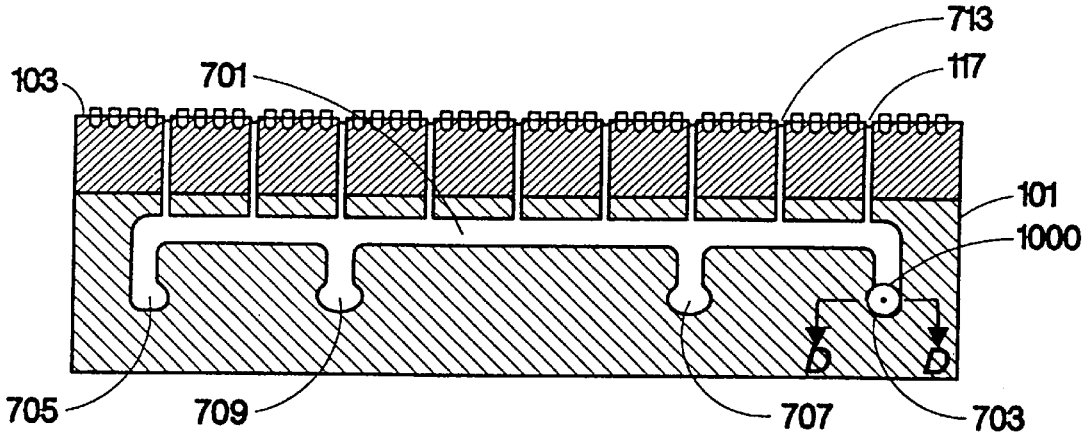
FIG. 7 is a left side elevation view of the printhead of FIG. 1 with the flex circuit and pump removed for clarity and better illustrating the ink feed channels and ink manifold which may be employed in the present invention.

Viewing now FIG. 7, one may perceive the ink plenum and manifold 701 of the preferred embodiment molded into one side of the fused silica glass block 101, the ink plenum and manifold 701 corresponds to the ink plenum and manifold 209 of FIG. 2. In the preferred embodiment, the ink plenum and manifold 701 is located on a side of the printhead block 101 which does not have the integrated circuits and which is not visible in FIG. 1. In the preferred embodiment the ink plenum and manifold 701 is molded to have a depth of 0.2 mm and a width of 0.5 mm. An ink inlet well 703 is disposed at one end of the ink plenum and manifold 701 and an ink outlet well 705 is disposed at the opposite end of the ink plenum and manifold 701. An additional ink inlet well 707 and an additional ink outlet well 709 may be utilized for trapped air management. Ink feed channels, for example 711 and 713 (corresponding to the ink feed channel 211 of FIG. 2), are formed in the sides and across the printing surface 103 of the block 101. A cover, not shown, is used to enclose the open portion of the ink plenum and manifold 701. A particular advantage to the ink plenum and manifold 701 molded into a side of the printhead block (which is held in a near vertical position during printer operation), is that air bubbles formed in the ink supply and in the integral ink feed channels 117 and 713 accumulate in the regions of the ink plenum and manifold 701 which are elevated over the integral ink feed channels 117 and 713. In such an orientation, air bubbles gather at the top of the ink plenum and manifold 701 and, since the ink is pressurized in the preferred embodiment, the air bubbles are swept out of the ink plenum without entering and clogging the ink integral feed channels 117 and 713.

Figure 8:
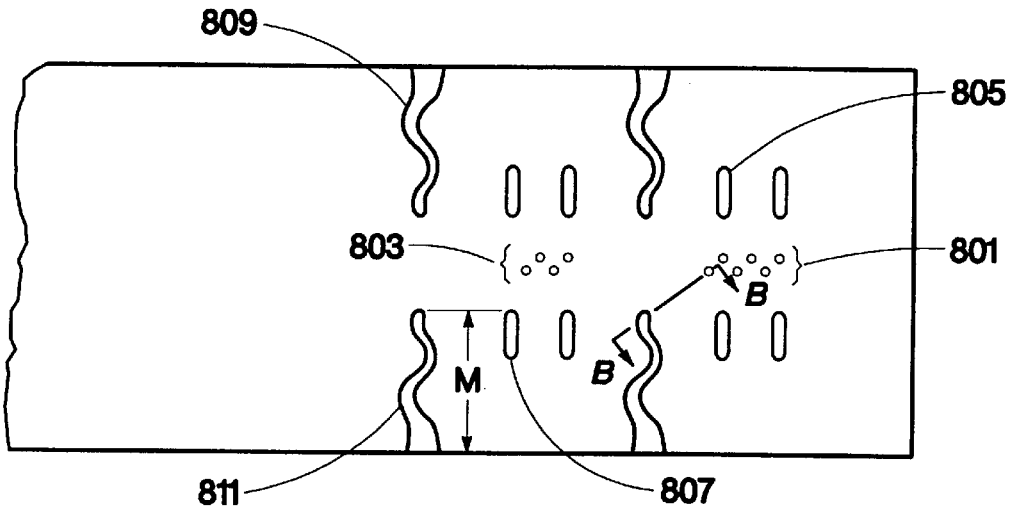
FIG. 8 is a view of a flex circuit which may be employed in the present invention.

FIG. 8 is a representation of the inner surface of the flex circuit 123 in which groups of orifices 801 and 803 are illustrated. This flex circuit 123 forms the orifice layer of the printhead. In order to maintain clarity, only a limited number of orifices are depicted. Further, only a limited number of reference indentations, for example indentations 805 and 807, are shown. Of particular interest are the expansion features 809 and 811. These features correspond to the expansion features 403 in the cross section B—B of FIG. 4. In the preferred embodiment, the expansion feature is a groove having an unflexed dimension of 1 mm wide at its narrowest point and 20 to 30 microns deep and is etched into the polyimide material in conventional fashion. The purpose of the expansion features is to provide resilience in the flex circuit 123 thereby enabling the flex circuit to expand in the long dimension and stretch to fit the printhead block 101. In the preferred embodiment, the expansion features 809 and 811 are grooves in the inner surface of the flex circuit and are disposed essentially perpendicular to the long dimension of the flex circuit. The expansion features, however, are created in a somewhat serpentine configuration about the generally perpendicular direction and are approximately twice as wide at the side edge as the expansion features are at their narrowest point near the center of the flex strip. In the preferred embodiment, the expansion features do not extend across the width of the flex circuit 123 but extend to a dimension M from the edge of the flex circuit to the inner wall of the reference indentations. In the preferred embodiment, twenty expansion features are disposed in the flex circuit not greater than 10 mm apart. While the configuration of the expansion features in the preferred embodiment provide the needed stretch performance of the flex circuit while maintaining dimensional stability in the orifice area, other expansion feature configuration, even one as simple as a straight line notch across the flex circuit may be employed.

Figure 9:
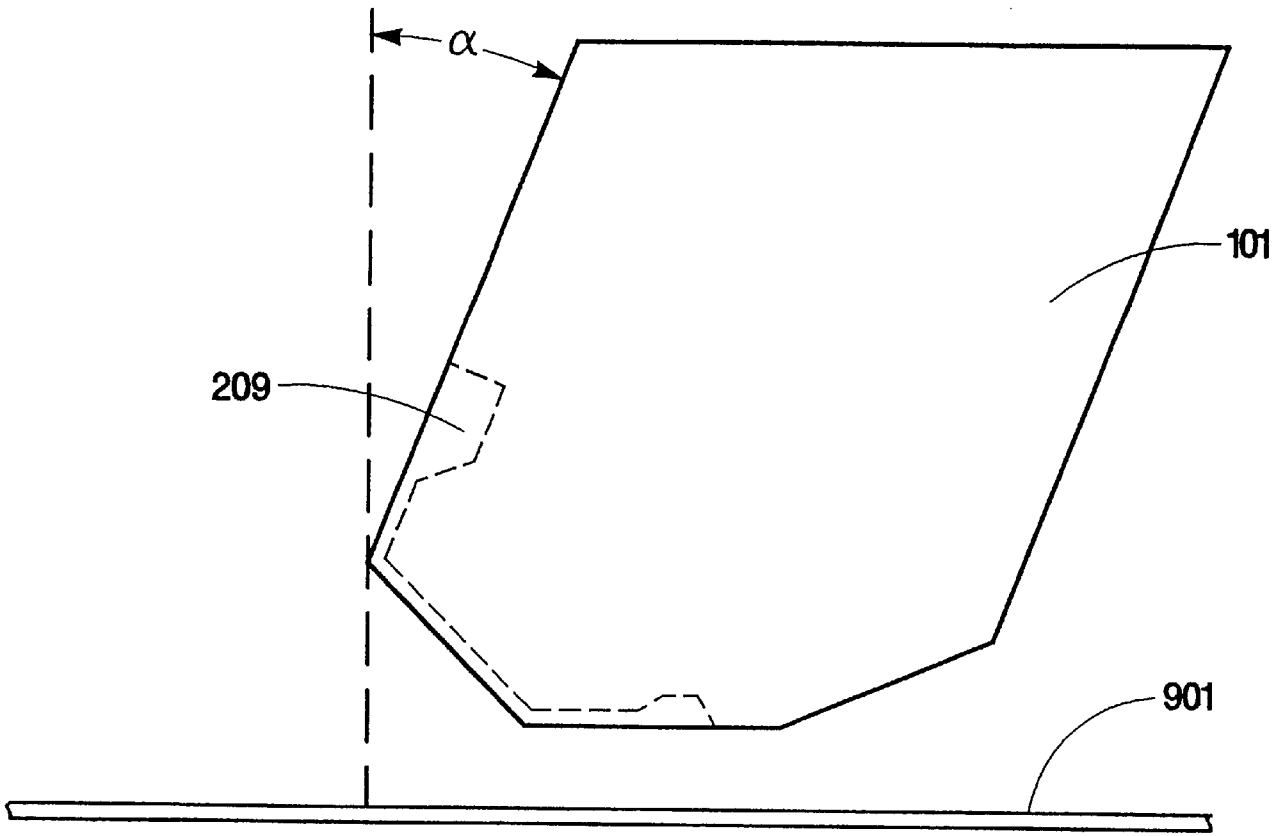
FIG. 9 is a side elevation view of a printhead illustrating its orientation relative to a medium.

In the preferred embodiment, the printhead is mounted such that the orifices are directed down toward a medium 901 and the ink droplets are expelled from the orifices in the same direction as the acceleration of gravity. The printhead, of course, is not limited to this direction of operation but it is the preferred orientation. In order to optimize the management of air bubbles which form in the ink, the printhead block 101 is offset from vertical by an angle ($\alpha$) of approximately 20°, as shown in FIG. 9, so that any ink bubbles which form in the ink path are accumulated in the gravitationally higher sections of the ink plenum and manifold 209 and 611. Since, in the preferred embodiment, the ink is pumped through the ink channels, the air bubbles are cleared from their collection locations by ink forced through the ink plenum by the pump.

Figure 10A:
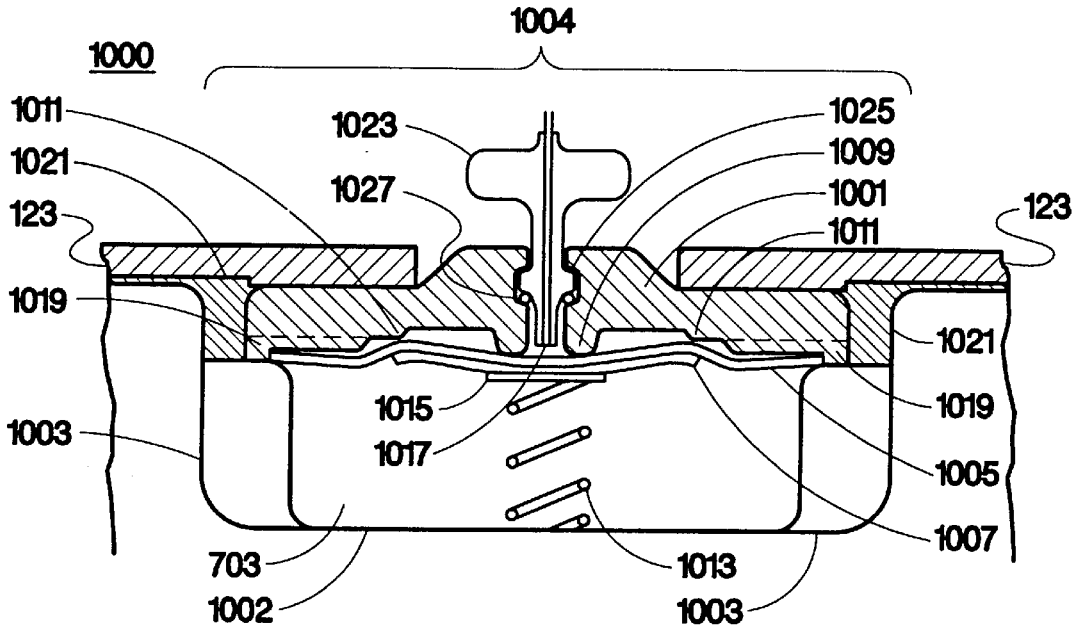
FIGS. 10A and 10B are cross sectioned views across section line D13 D of FIG. 7 of an ink pump which may be employed in the present invention.

In the preferred embodiment, a pump 1000 is a piezoelectric pump is mounted in the ink inlet well 703 and is coupled to an ink supply (not shown) by a fluid coupler and a supply tube. A cross section of the ink inlet well and piezoelectric pump mounted in the ink inlet well 703 of the block 101 is shown in FIG. 10A. One can see that the ink inlet well 703 has an opening at the surface of the block and a bottom 1002 in the block opposite the surface opening. A pump mount 1001, consisting of a thermal or ultra sonic weldable polymer material, is conventionally secured to a roughened inner ridge wall 1003 such that an enclosed chamber is created. Secured beneath the pump mount 1001 and coupled to electrical connections (not shown) on the inner ridge wall 1003 is a piezoelectric laminate polymer disk 1005 which extends downward when an activating electrical voltage is applied. Further discussion regarding the theory of piezoelectric materials which might be applicable to alternative construction of the piezoelectric disk may be found in T. T. Wang et al. (editors), *The Applications of Ferroelectric Polymers,* Blackie and Son, Ltd., London, 1988, pp. 305–328. In the inactivated state, the piezoelectric disk is urged by a curved washer 1007 against a circular central ridge 1009 and a circular ridge 1011, concentric with the central ridge 1009, but at a larger radius than the central ridge 1009. The energy for urging the piezoelectric disk 1005 against the pump mount 1001 is provided by a spring 1013 (shown as a coil spring formed from a high modulous fluro polymer, but not necessarily so limited) by way of a slightly bowed flat washer 1015. The use of the two washer implementation provides a mechanism which will first seal the central ink inlet 1017 in the pump mount 1001 and then seal the circular ridge 1011. This two step operation prevents ink from being forced back into the ink supply while forcing ink out of channels forming an outlet 1019 in the pump mount 1001 and into collection areas 1021 of the ink inlet well 703, thus providing a fluid pressure throughout the ink plenum. The ink inlet well and pump are covered, except for the ink supply fitting 1023, by the flex circuit 123. In the preferred embodiment, the supply fitting 1023 has a circular bulge 1025 which snaps into a mating socket in the pump mount 1001. Leak prevention is obtained from an O-ring seal 1027.

Figure 10B:
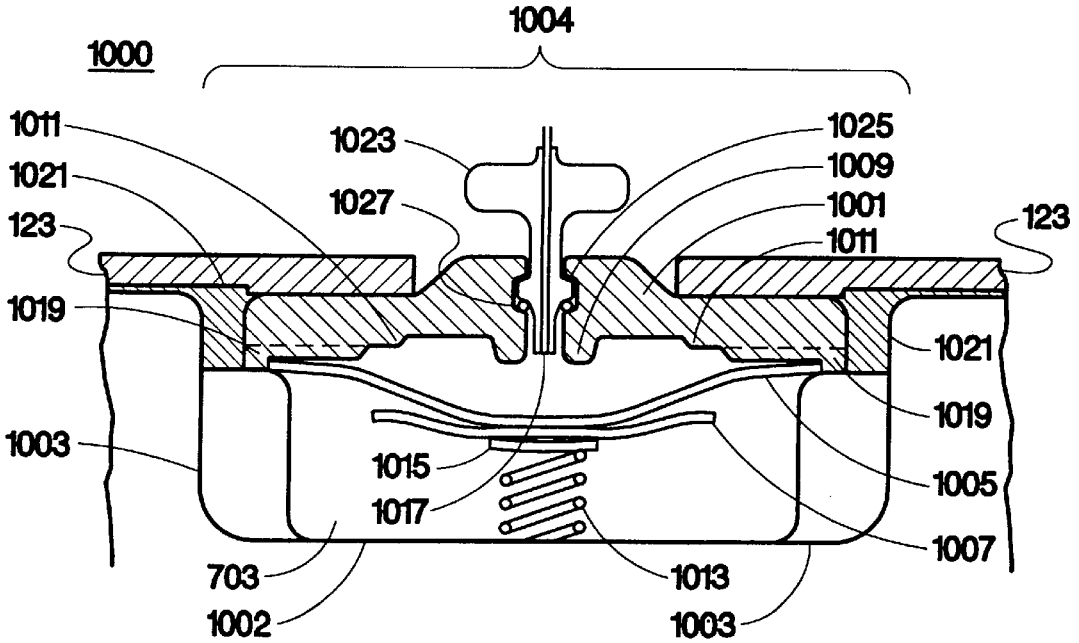
Figure 11:
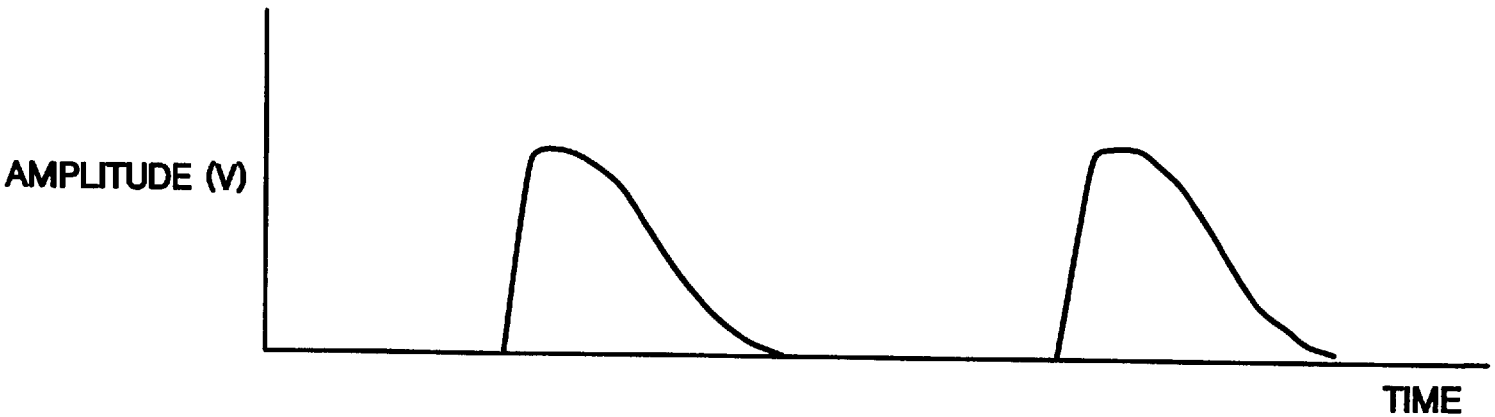
FIG. 11 is voltage amplitude versus time graph indicating an electrical wave form which may be applied to an ink pump in the present invention.

When the piezoelectric disk 1005 is energized, it pushes against the spring 1013 and opens a volume which is rapidly filled with ink from the ink supply. This state can be perceived from the illustration of FIG. 10B. When the piezoelectric disk is driven with a rapidly rising, slow decay waveform such as that shown in FIG. 11, the piezoelectric disk 1005 moves between the two states shown in FIGS. 10A and 10B thereby forcing ink into the ink plenum. A similar pump design, but rearranged to draw ink from the ink plenum and manifold, may be positioned in the ink outlet well (for example ink outlet well 705). This alternative draws ink (and any air bubbles) from the plenum and expels the ink into an ink reservoir (not shown) via the outlet and feed tubes.

Figure 14:
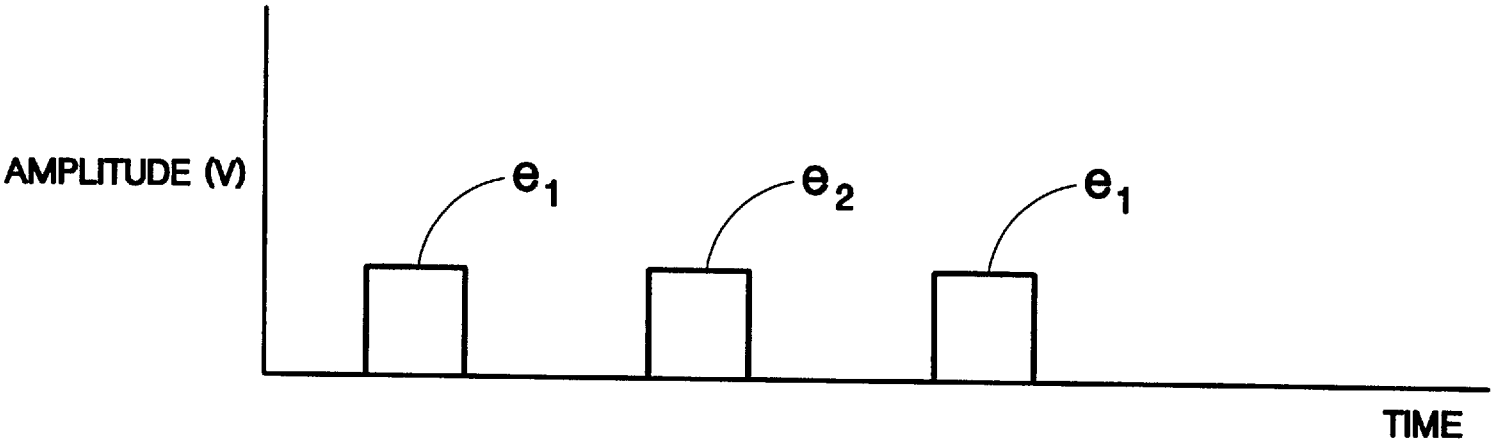
FIG. 14 is a voltage amplitude versus time graph indicating electrical waveforms which may be applied to a peristaltic pump in the present invention.
Figure 12:
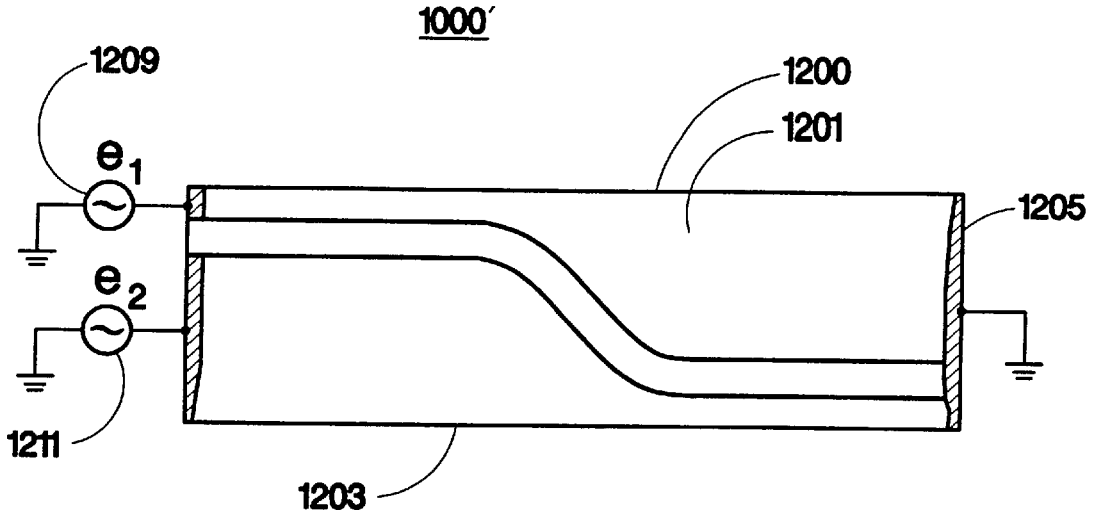
FIG. 12 is a view of a piezo-oriented film which may be employed in a peristaltic ink pump in the present invention.
Figure 13:
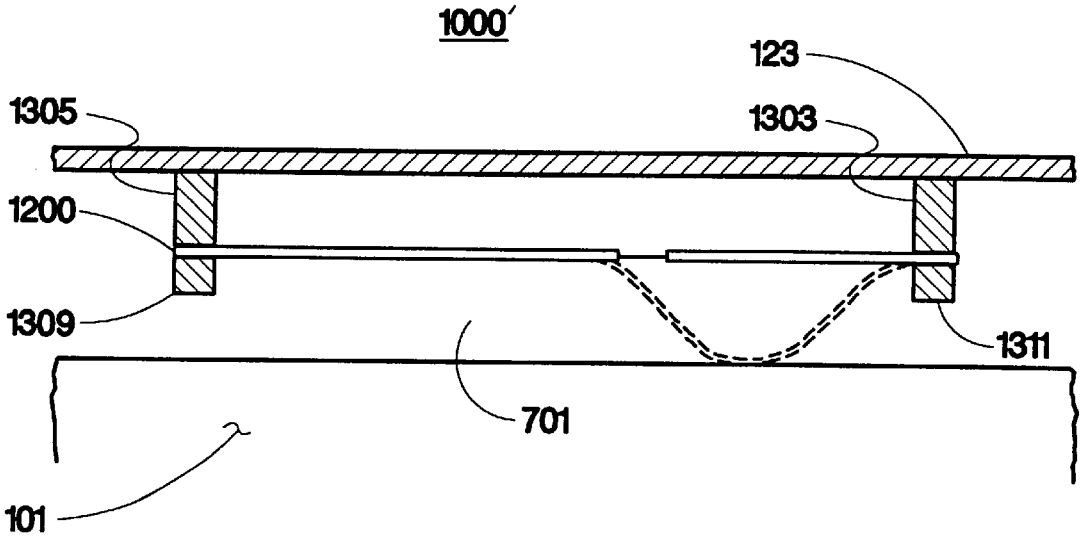
FIG. 13 is a cross sectioned view of a peristaltic ink pump apparatus which may be disposed longitudinally in an ink plenum and manifold of a printhead in accordance with the present invention.

An alternative embodiment of an ink pump 1000 which may be employed in the present invention is shown in FIGS. 12. and 13. A linear peristaltic pump is realized by a strip of multilayer orientated PVDF (polyvinylidine fluoride) material commonly recognized as a piezoelectric material film 1200, 10 mm by 30 mm and 0.5 mm thick. Two electrodes 1201 and 1203 are disposed upon the piezoelectric material in interlocking (but not electrically connecting) patterns which have a large surface pattern of one electrode at one end of the strip and a large surface area pattern of the other electrode at the opposite end of the strip. The electrodes can share a common electrical connection 1205 at one end of the strip but are driven from independent connections 1205 and 1207 by independent but related electrical sources ($e_1$ and $e_2$) 1209 and 1211, respectively. The alternative embodiment pump is installed in the plenum and manifold between the ink input well 703 and the remainder of the ink plenum and manifold. The mounting can be perceived from the cross section of the printhead block 101 shown in FIG. 13. The flex circuit 123 is provided protrusions 1303 and 1305 which secure the piezoelectric material film 1200 against protrusions 1309 and 1311 of the block 101. In the preferred embodiment, the protrusions 1303 and 1305 couple electrical signals to the piezoelectric material film 1200 and provide a restriction of ink flow above the film 1307. When each of the electrodes 1201 and 1203 are sequentially pulsed with electrical signals such as those shown in FIG. 14, first one end of the piezoelectric material film 1200 bends downward into the ink channel followed by a bending of the other end of the piezoelectric material film 1200 into the channel. The condition of one end bending into the channel is illustrated in phantom in FIG. 13. As first one end then the other end bending, ink is pushed along the channel by a peristaltic motion of the film. One advantage of the peristaltic pump of the alternative embodiment is that the pump desirably is operated at frequencies in excess of 100 Hz.

What is claimed is:

1. A printhead for an inkjet printer, comprising:

a thermally stable base having an integral ink feed channel and a plenum and manifold disposed therein;

a plurality of ink firing chambers disposed on said thermally stable base and supplied with ink by way of said integral ink feed channel; and a pump disposed on said thermally stable base, coupled to said integral ink feed channel, and circulating ink through said plenum and manifold for supplying ink to said integral ink feed channel for subsequent supply to and expulsion by said ink firing chambers.

2. A printhead for an inkjet printer in accordance with claim 1 wherein said thermally stable base further comprises an integral ink inlet well having a surface opening in said thermally stable base and a bottom of said integral ink inlet well at an opposite side of said integral ink inlet well from said surface opening and wherein said pump further comprises a piezoelectric disk disposed between said bottom of said integral ink inlet well and said surface opening in said thermally stable base.

3. A printhead for an inkjet printer in accordance with claim 2 wherein said pump further comprises:

a pump mount having an inlet forming an ink input to said pump and disposed at said surface opening in said thermally stable base of said integral ink inlet well, said pump mount securing said piezoelectric disk between said bottom of said integral ink inlet well and said surface opening in said thermally stable base;

a washer; and a spring contacting said bottom of said integral ink inlet well and urging said washer against said piezoelectric disk whereby said piezoelectric disk is held against and seals said inlet when said piezoelectric disk is not electrically activated.

4. A printhead for an inkjet printer, comprising a thermally stable base having an integral ink feed channel and a plenum and manifold disposed therein, said thermally stable base further comprising:

an integral ink inlet well having a surface opening in said thermally stable base, said plenum and manifold coupled to said integral ink inlet well and said ink feed channel, and wherein said pump further comprises a piezoelectric material film disposed in said plenum and manifold;

a plurality of ink firing chambers disposed on said thermally stable base and supplied with ink by way of said integral ink feed channel; and a pump disposed on said thermally stable base, coupled to said integral ink feed channel, and circulating ink through said plenum and manifold for supplying ink to said integral ink feed channel for subsequent supply to and expulsion by said ink firing chambers.

5. A method of producing a printhead for an inkjet printer, comprising the steps of:

disposing a plurality of ink firing chambers on a thermally stable base;

forming, in fluid communication with said in firing chambers, at least one integral ink feed channel and a plenum and manifold in said thermally stable base; and mounting a pump on said thermally stable base, coupling said mounted pump to said at least one integral ink feed channel by way of said plenum and manifold, whereby ink is circulated through said plenum and manifold for supplying ink to said integral ink feed channel for subsequent supply to and expulsion by said ink firing chambers.

6. A method in accordance with the method of claim 5 further comprises the step of forming an integral ink inlet well having a surface opening in said thermally stable base and a bottom of said integral ink inlet well at an opposite side of said integral ink inlet well from said surface opening.

7. A method in accordance with the method of claim 6 further comprising the steps of:

attaching a pump mount having an inlet forming an ink input to said pump, within said integral ink inlet well surface opening in said thermally stable base;

securing a piezoelectric disk in said integral ink inlet well; and urging said piezoelectric disk against and sealing said inlet when said piezoelectric disk is not electrically activated.

8. A printhead for an inkjet printer in accordance with claim 1 wherein said thermally stable base further comprises an integral ink outlet well having a surface opening in said thermally stable base and a bottom of said integral ink outlet well at an opposite side of said integral ink outlet well from said surface opening and wherein said pump further comprises a piezoelectric disk disposed between said bottom of said integral ink outlet well and said surface opening in said thermally stable base.

9. A printhead for an inkjet printer, comprising:

a thermally stable base having an integral ink feed channel and a plenum and manifold disposed therein;

a plurality of ink firing chambers disposed on said thermally stable base and supplied with ink by way of said integral ink feed channel;

a pump disposed on said thermally stable base, coupled to said integral ink feed channel, and a piezoelectric disk disposed between said bottom of said integral ink outlet well and said surface opening in said thermally stable base to circulate ink through said plenum and manifold for supplying ink to said integral ink feed channel for subsequent supply to and expulsion by said ink firing chambers;

an integral ink outlet well disposed in said thermally stable base and having a surface opening in said thermally stable base and a bottom of said integral ink outlet well at an opposite side of said integral ink outlet well at an opposite side of said integral ink outlet well from said surface opening;

a pump mount having an outlet forming an ink outlet from said pump and disposed at said surface opening in said thermally stable base of said integral ink outlet well, said pump mount securing said piezoelectric disk between said bottom of said integral ink outlet well and said surface opening in said thermally stable base;

a washer; and a spring contacting said bottom of said integral ink outlet well and urging said washer against said piezoelectric disk whereby said piezoelectric disk is held against and seals said outlet when said piezoelectric disk is not electrically activated.

10. A method in accordance with the method of claim 5 further comprises the step of forming an integral ink outlet well having a surface opening in said thermally stable base and a bottom of said integral ink outlet well at an opposite side of said integral ink outlet well from said surface opening.

11. A method in accordance with the method of claim 10 further comprising the steps of:

attaching a pump mount, having an outlet forming an ink output from said pump, within said integral ink outlet well surface opening in said thermally stable base;

securing a piezoelectric disk in said integral ink outlet well; and urging said piezoelectric disk against and sealing said outlet when said piezoelectric disk is not electrically activated.

* * * * *